United States Patent [19]

Morrison et al.

[11] 4,260,029

[45] Apr. 7, 1981

[54] MIDPOINT CENTRALIZER

[75] Inventors: Ward D. Morrison, South Acworth; Ralph C. Lumbra, Claremont, both of N.H.

[73] Assignee: Joy Manufacturing Company, Pittsburgh, Pa.

[21] Appl. No.: 973,659

[22] Filed: Dec. 27, 1978

[51] Int. Cl.[3] ..... E21C 9/00

[52] U.S. Cl. ..... 173/1; 173/20; 175/220; 408/16

[58] Field of Search ..... 173/1, 20; 175/57, 61, 175/220; 308/3.9, 4 R; 408/241 G, 116, 16

[56] References Cited

U.S. PATENT DOCUMENTS

| | | | |
|---|---|---|---|
| 1,488,525 | 4/1924 | Bayles | 308/3.9 |
| 1,585,668 | 5/1926 | Hansen | 308/3.9 |
| 1,587,949 | 6/1926 | Hansen | 173/112 X |
| 1,614,123 | 1/1927 | Hansen | 308/3.9 |
| 1,986,266 | 1/1935 | Hirschberg | 173/141 |
| 3,101,006 | 8/1963 | Kurt | 175/220 X |
| 3,231,318 | 1/1966 | Ytterfors | 308/3.9 |
| 3,749,454 | 7/1973 | Bailey et al. | 308/3.9 |
| 3,835,939 | 9/1974 | McEntire | 173/1 X |

*Primary Examiner*—James A. Leppink
*Attorney, Agent, or Firm*—Charles A. Bevelacqua

[57] ABSTRACT

A method and apparatus for maintaining alignment of the drill steel or drill rod of a drilling machine in which a midpoint centralizer or indicator ring having an aperture therethrough substantially greater than the diameter of the drill rod or drill steel is used like a rifle sight to indicate the nature and degree of misalignment so that adjustments can be made in the operating mechanisms of the drilling machine or the support and positioning mechanisms for the drilling machine to remove the cause of the misalignment and to return the drill steel to its centered, aligned position in the indicator ring. In normal operation the drill steel does not contact the indicator ring so that noise transmission and frictional losses normally associated with midpoint centralizers is avoided. Mechanical contact between the drill steel and indicator ring occurs only to limit the maximum deflection and maximum stress which will occur in the drill steel due to bending. Guided by the indications at the indicator ring a skilled operator can greatly reduce or substantially avoid the occasions when mechanical contact actually occurs.

7 Claims, 2 Drawing Figures

MIDPOINT CENTRALIZER

BACKGROUND OF THE INVENTION

Figure 1:
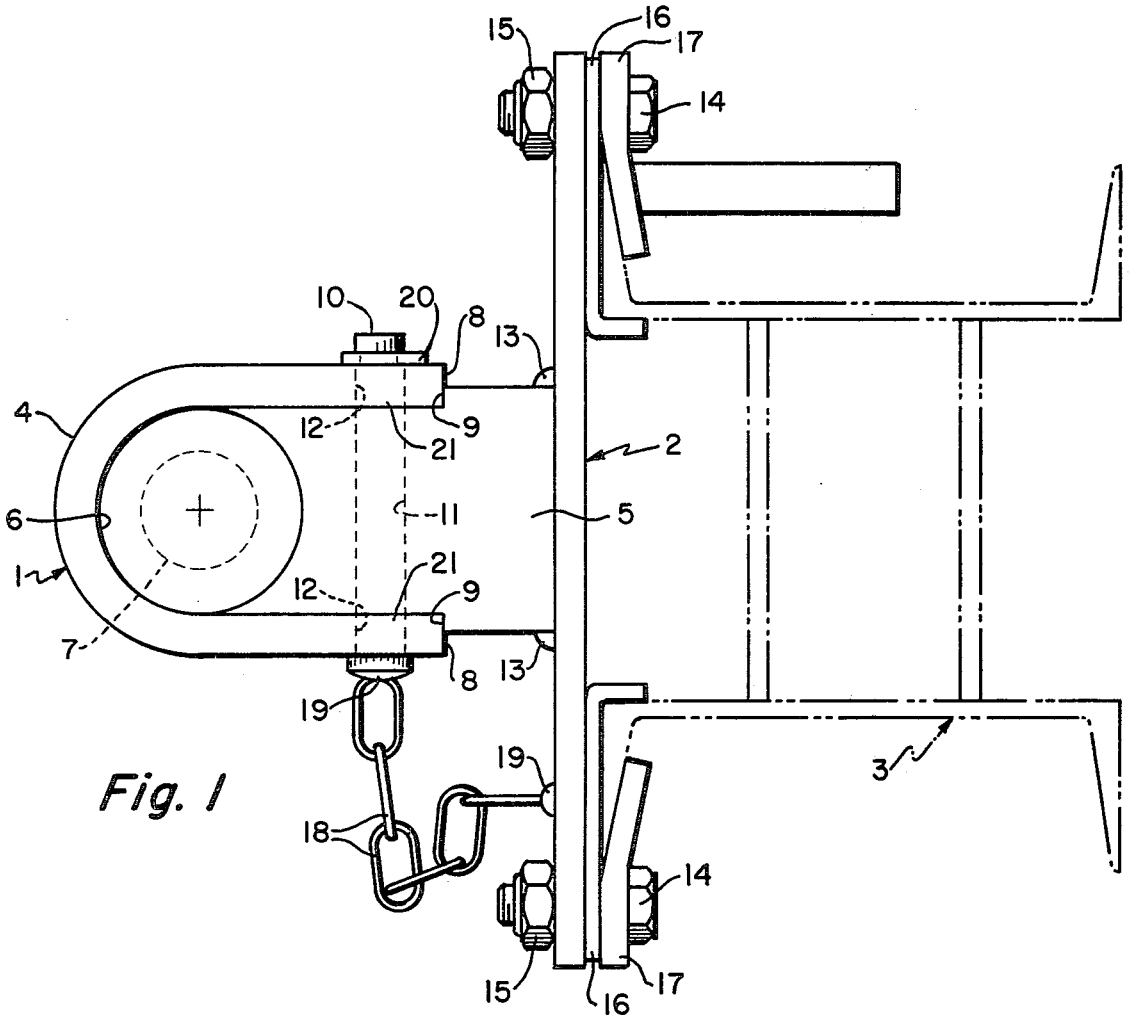

For the purpose of the descriptions herein the invention is described in reference to a rock drill although it is apparent that it may be used as well with other types of drilling machines.

It is common in rock drills or other drilling machines to provide a centralizer or collaring means at the working extremity of the drill steel adjacent to the point at which the drill bit and drill steel enter the material being drilled to maintain the drill in centered relation to the hole being drilled. In large drills, particularly those designed and used for drilling in a horizontal or vertical position or for drilling long or deep holes, a feed mechanism is provided for mechanically forcing the drill bit against the material being drilled. The drill steels or rods used in these operations may be up to 10 feet or more in length and under the pressure of the feed mechanism or if the drill becomes misaligned with the hole being drilled tend to bend and bow. A second centralizer, a midpoint centralizer, is provided to attempt to prevent deflection of the drill steel. These midpoint centralizers generally take the form of heavy, drill steel encircling members attached to the drill feed mechanism or some other rigid base which forceably restrain the drill rod against deflection. The position of the centralizer is controlled so that it also moves foward as the drill is advanced but at about one-half the speed at which the drill is advanced so that the centralizer constantly maintains a position approximately at the midpoint of the exposed portion of the drill steel between the point where the drill bit and drill steel enter the material being drilled and the drill mechanism. Such prior midpoint centralizers cause excessive noise and friction and since they fit tightly around the drill steel or have minimal clearance, they reduce the length to which the operator can drill with a given length of drill steel by the width of the coupling by which the drill steel is attached to the striking bar of the drill since the coupling will not pass through the centralizer.

SUMMARY OF INVENTION

The present invention is directed to new and novel means and method for maintaining the alignment of the midpoint of a drill steel which eliminate the disadvantages of the prior art centralizers and methods and permit quieter, more efficient drilling. Instead of attempting to closely, forceably restrain the drill steel in an aligned position, the centralizer or indicator ring in this invention permits limited misalignment and restrains the drill rod only against excessive bending stresses. In the method of this invention the misalignment caused by excessive drill feed, slow drilling speed or misalignment of the axis of the drill with the axis of the hole being drilled is used as an indication of the corrective adjustments required to remove the cause of the misalignment. The method of this invention involves the detection and removal of the cause of a misalignment which occurs rather than a forceful resistance against such causes while permitting them to remain and which may amplify or compound them. Faster, quieter, more efficient drilling is possible using the centralizer indicator ring and method of the present invention than was possible with previously employed centralizers and methods.

It is an object of this invention to provide a travelling midpoint indicator ring which does not normally contact the drill steel except to limit the maximum permissible deflection of the drill steel.

It is also an object of this invention to provide a an indicator ring having an opening therethrough considerably larger than the diameter of the drill steel so that contact between the two is generally avoided and excessive noise and friction thereby eliminated and the efficiency of the drilling operation greatly increased.

It is a further object to this invention to provide indicator ring which allows the coupling between the drill steel and the striking bar to pass therethrough thus permitting the drilling of a deeper hole with a given length of drill steel.

It is an important object of this invention to disclose a new and novel method of maintaining the alignment of a drill steel with the longitudinal axis of the working mechanism of a drilling machine, for example, the striking bar of a rock drill, wherein the indicator ring is used to provide an indication of the degree and cause of misalignment and to serve as the basis for making corrective adjustments to remove that cause rather than merely as a mechanical means attempting to restrain the drill steel against the effects of misalignment.

Another object of this invention is to teach a new and novel method of maintaining alignment of a drill steel with the longitudinal axis of the working mechanism of a drilling machine, for example, the striking bar of a rock drill, which permits the operator to see the effects of adjustments he makes in the operating modes or support means of the drilling machine so that he may effectively eliminate the cause of misalignment.

Another object of this invention is the provision of a method of maintaining alignment between a drill steel and the longitudinal axis of the working mechanism of a drilling machine, for example, the striking bar of a rock drill, which eliminates unnecessary noise and friction and increases the efficiency of the drilling operation.

These and other objects and advantages of this invention will become apparent and be more fully understood from the following description and accompanying drawings.

Drilling machines and parts thereof of the type with which this invention may be used, for example, rock drills, rock drill mechanisms, drill bits, drill supports and feed mechanisms, front centralizers or collaring means and midpoint centralizer drive means which maintain the centralizer or indicator ring at approximately the midpoint between the working face and the front end of the drill as the drill is advanced into the work, are all well known and are not shown.

In the drawings

Figure 2:
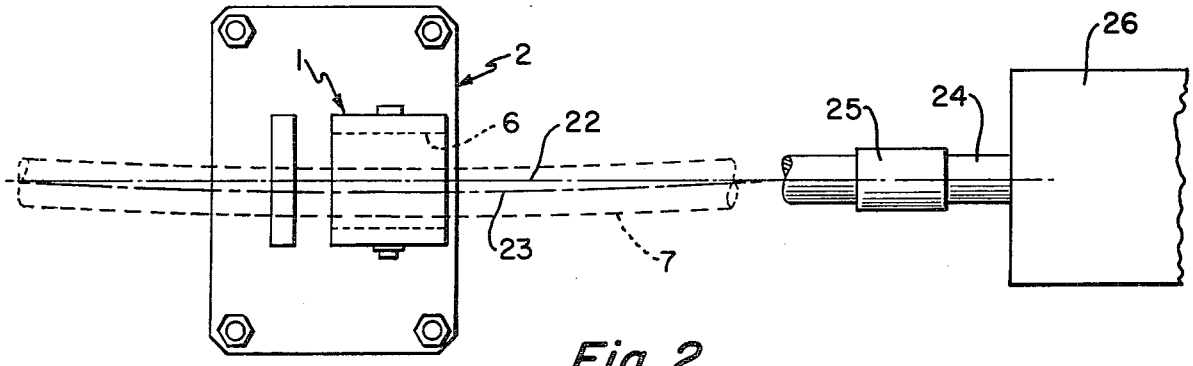

FIG. 1 is an end view of a midpoint centralizer made in accordance with the invention and FIG. 2 is a plan view partially in phantom of a centralizer in relation to a drilling machine.

DESCRIPTION OF THE INVENTION

Referring now to the drawings, there is shown an indicator ring 1 carried by a base 2 which in turn is mounted on a support bracket 3 which moves with the drill feed mechanism. The centralizer consists of a U-shaped. cap or drill steel encircling member 4 attached to and cooperating with a body member 5 to form a longitudinal cylindrical indicator ring opening or bore 6 which surrounds a drill steel 7 in spaced relation. The internal diameter of the indicator ring is on the order of 1.25 to 2.0 or more times the diameter of the drill steel with which it is to be used, with a ratio of 1.4 to 1.7 preferred. The cap is held in rigid, aligned relationship with the body 5 by the engagement of the end surfaces 8 with the notches 9 formed in the body member and is locked in place by the pin 10 which passes through corresponding apertures or bores 11 and 12 in the body member and in the leg portions 21 of the cap member respectively. Attachment of the body member 5 to the base 2 may be by fillet welds as indicated at 13 or by any other conventional fastening means. The base 2 is in turn attached to the support member 3 by suitable bolts, nuts, spacers and adaptors as indicated at 14, 15, 16 and 17, respectively. The pin 10 may be secured against loss or misplacement by a short length of chain 18, tack welded or otherwise secured to the pin and to the base member as indicated at 19. Pin 10 is locked in place by a retainer 20.

FIG. 2 shows partially in phantom a drill steel connected by a coupling 25 to the striking bar 24 of a drilling machine 26. A drill steel is shown in phantom in a bowed condition as would be the case if excessive feed is applied during drilling.

OPERATION

To assemble the indicator ring to a rock drill, support member 3 is attached to the drill feed mechanism so that the indicator ring is supported by the drill feed mechanism in axial alignment with the striking bar and at about the midpoint of the drill steel. For a particular drill and feeding mechanism the height of body 5 is selected so that the longitudinal axis 22 of the bore 6 of the indicator ring coincides with the longitudinal axis of the striking bar. The retainer 20 is removed so that the pin 10 can be withdrawn and cap 4 is disassembled from the body member. A drill steel 7 and a drill bit are then assembled to the drill; the drill steel being supported between the striking bar of the drill and a front centralizer and passing through the bore 6 of the indicator ring. Conventionally the drill steel is held in engagement with the striking bar by a coupling having an outer diameter greater than the diameter of the drill steel and threadedly engaged with the drill steel and the striking bar. Cap member 4 is then put back in place, pin 10 is inserted through the bores 11, 12 to lock the cap 4 to the body 5 and the pin locked in place with retainer 20. At this point the drill steel 7 is centered in and aligned with the indicator ring opening 6.

After the drill and indicator ring are assembled as described above drilling can be commenced and the drill advanced into the work in a conventional manner. The centralizer 1 is also advanced by known means so that it always remains substantially at the midpoint of the drill steel between the front centralizer and the drill.

In operation, if the drill is properly aligned with the hole being drilled and the rate of advance of the drill by the feed mechanism is substantially equal to the rate of penetration of the drill bit into the work, the drill steel will remain in the approximate center of the indicator ring opening as shown in FIG. 1. However, if the drill mechanism becomes misaligned with the drill steel or if the drill bit wanders as it penetrates the work, the drill steel will be deflected away from the center of the indicator ring centralizer toward the periphery of the opening 6. If the feed mechanism advances the drill faster than the penetration of the drill into the material being drilled, the drill steel will tend to bow inside the indicator ring opening. In either case limited off-center movement of the drill steel is permitted by the indicator ring which acts only to limit the maximum permissible deflection and to indicate to the operator the misalignment condition. Unless the deflection or misalignment of the drill steel exceeds the maximum deflection permitted by the indicator ring, there is no contact between the drill steel and the indicator ring. This avoids the generation and transmission of noise and frictional engagement between the drill steel and the indicator ring which would consume power and reduce the efficiency of the drill. Misalignment or deflection of the drill steel causing it to move away from its centered position in the opening of indicator ring 1 will become quickly apparent to the operator of the drill who uses the indicator ring like a rifle sight. The inner surface of the bore 6 provides a reference by which any deviation of the drill steel from exact alignment as it passes therethrough will be visibly indicated. The operator then makes appropriate adjustments in the drill feed or in the drill supporting means to bring the drill steel back into its centered position. Relatively small deflections of the drill steel can be noticed and corrected in this manner. The indicator ring will mechanically limit any tendency of the drill steel to deflect beyond the radius of the indicator ring opening 6 thus limiting the maximum bending stress in the drill steel. Upon observing the nature and degree of deflection of the drill steel, the operator is able to make corrections or changes to the drill feed rate or to the position of the drilling machine and thus eliminate the cause of the misalignment condition. In actual use the operator uses the indicator ring like a rifle sight and controls the various functions of the drilling machine and the mechanism supporting it to maintain the drill steel in centered, aligned condition.

It can be seen from the above that this invention has provided a new method and apparatus which permits detection and correction of relatively small deflections and misalignment of the drill steel in a manner which permits faster, quieter, more efficient operation of a rock drill, while providing a positive mechanical limit to the deflection of a drill steel and the bending stresses introduced by such deflection.

Whereas the preferred embodiment of the invention has been shown and described it will be evident that numerous changes and variations can be made in the details thereof without departing from the invention as defined and claimed in the appended claims.

What is claimed:

1. A method of controlling the alignment and deflection of a drill steel of a drilling machine of the type which is supported and positioned by adjustable means and which is advanced toward the work by an adjustable feed mechanism and having a front centralizer and an indicator ring, a portion of which indicator ring encircles a drill steel carried by said drilling machine, the method comprising:

positioning and maintaining the indicator ring so that the longitudinal axis of the portion of the indicator ring encircling said drill steel coincides with the longitudinal axis of the drill steel when the latter is in an aligned and undeflected condition, providing an aperture in said portion of the indicator ring of sufficient size to permit readily visible deflection or misalignment of the drill steel within said aperture during drilling without mechanical contact between the drill steel and said portion of the indicator ring, observing any deflection or misalignment of the longitudinal axis of the drill steel with respect to the longitudinal axis of the portion of the indicator ring encircling the drill steel during drilling, and adjusting the feed mechanism and the supporting and positioning means while continuously observing the indications of deflection or misalignment to return the longitudinal axis of the drill steel into coincidence with the axis of the portion of the indicator ring encircling the drill steel.

2. A method as set forth in claim 1 wherein said aperture is substantially cylindrical and of a diameter at least 1.25 times the diameter of the drill steel.

3. An indicator ring for a drilling machine having a striking bar and a drill steel operatively engaged with said striking bar and having a front centralizer located adjacent the point where the drill steel enters the material being drilled, said indicator ring comprising a drill steel encircling member located between said front centralizer and said striking bar, a longitudinal bore of substantially greater diameter than the diameter of the drill steel extending through said drill steel encircling member and adapted to receive the drill steel and means for positioning and maintaining said drill steel encircling member so that the longitudinal axis of said bore coincides with the longitudinal axis of the drill steel when the drill steel is in operating position in the drill, centered and aligned with the striking bar, said longitudinal bore being approximately 1.25 to 2 times the diameter of the drill steel so that the drill steel is allowed to move laterally without restraint for a limited distance within said bore to indicate deflection or misalignment of the drill steel during drilling.

4. An indicator ring as in claim 3 wherein the drill steel is attached to said striking bar by a coupling encircling the drill steel and the bore in said drill steel encircling member is of a diameter to at least permit easy admittance of said coupling therein.

5. An indicator ring as set forth in claim 3 wherein limited deformation or deflection of the drill steel can occur without physical contact between the drill steel and said longitudinal bore.

6. An indicator ring as set forth in claim 3 wherein said drill steel encircling member will mechanically restrain the drill steel against lateral deformation or displacement beyond a predetermined maximum.

7. An indicator ring as set forth in claim 3 wherein said drill steel encircling member is located and maintained approximately at the midpoint of the portion of the drill steel extending between the striking bar and the point where the drill steel enters the material being drilled.

* * * * *

UNITED STATES PATENT AND TRADEMARK OFFICE

CERTIFICATE OF CORRECTION

PATENT NO. : 4,260,029

DATED : April 7, 1981

INVENTOR(S) : Ward D. Morrison and Ralph C. Lumbra

It is certified that error appears in the above-identified patent and that said Letters Patent are hereby corrected as shown below:

Column 2, line 11 delete "to" and insert --of--.

Column 3, line 28 after "ring" insert --1--.

Column 3, line 52 delete "centralizer" and insert --indicator ring--.

Column 3, line 64 delete "centralizer".

Signed and Sealed this

*Thirtieth* Day of *June 1981*

[SEAL]

*Attest:*

RENE D. TEGTMEYER

*Attesting Officer*

*Acting Commissioner of Patents and Trademarks*